US008899580B2

(12) United States Patent
Liu et al.

(10) Patent No.: US 8,899,580 B2
(45) Date of Patent: Dec. 2, 2014

(54) SHEET-TYPE MEDIUM STACKING AND GUIDING DEVICE, AS WELL AS CONTROL SYSTEM AND METHOD BASED ON THE SAME

(75) Inventors: Heng Liu, Guangzhou (CN); Dong Tan, Guangzhou (CN); En Wu, Guangzhou (CN); Fa Ran, Guangzhou (CN)

(73) Assignee: GRG Banking Equipment Co., Ltd., Guangzhou (CN)

( * ) Notice: Subject to any disclaimer, the term of this patent is extended or adjusted under 35 U.S.C. 154(b) by 0 days.

(21) Appl. No.: 13/884,268

(22) PCT Filed: Jul. 9, 2012

(86) PCT No.: PCT/CN2012/078358

§ 371 (c)(1), (2), (4) Date: May 9, 2013

(87) PCT Pub. No.: WO2013/026333

PCT Pub. Date: Feb. 28, 2013

(65) Prior Publication Data

US 2014/0175738 A1 Jun. 26, 2014

(30) Foreign Application Priority Data

Aug. 19, 2011 (CN) ..... 2011 1 0240238

(51) Int. Cl.
*B65H 31/20* (2006.01)
*B65H 5/00* (2006.01)

(Continued)

(52) U.S. Cl.
CPC ..... *B65H 5/00* (2013.01); *B65H 29/52* (2013.01); *B65H 31/20* (2013.01); *B65H 31/38*

(Continued)

(58) Field of Classification Search
CPC ..... B65H 1/04; B65H 2511/10; B65H 1/266; B65H 2511/12
USPC ..... 271/171, 221, 223, 1
See application file for complete search history.

(56) References Cited

U.S. PATENT DOCUMENTS 5,511,713 A * 4/1996 Sakaguchi et al. ..... 242/615.3
5,639,078 A * 6/1997 Mandel et al. ..... 270/58.12

(Continued)

FOREIGN PATENT DOCUMENTS

CN 1295965 A 5/2001
CN 2489966 A 5/2002

(Continued)

*Primary Examiner* — Prasad Gokhale
(74) *Attorney, Agent, or Firm* — Kilpatrick Townsend & Stockton LLP

(57) ABSTRACT

Disclosed in the present invention is a sheet-type medium stacking and guiding device, also disclosed in the present invention are a control system and a method based on the same. The device comprises: a left limiting plate (14) and/or a right limiting plate (19), which locate at the outer end of a medium passage made up of a left and a right passage plate (301, 304); a driving mechanism (25), which is in transmission connection with the limiting plates and drives the limiting plates to move along the longitudinal direction of the medium. The system comprises a central control module (901), a detection module (902), a data processing module (903), an image acquisition module (904), a storage module (905) and an execution module (906). The method comprises: identifying the species of the medium to be arranged; querying the property of the medium to be arranged, obtaining the length value of the medium; calculating and outputting the servo signal for the executing component of the driving mechanism, driving the limiting plates to move to a predetermined position along the longitudinal direction of the medium. The medium arranging range can be increased by adjusting the position of the limiting plates to meet the requirements of the stacking medium with different lengths.

15 Claims, 5 Drawing Sheets

(51) Int. Cl.

| | |
|---|---|
| ***B65H 29/52*** | (2006.01) |
| ***B65H 31/38*** | (2006.01) |
| ***B65H 29/40*** | (2006.01) |
| ***B65H 31/02*** | (2006.01) |
| ***G07D 11/00*** | (2006.01) |
| ***B65H 7/06*** | (2006.01) |
| ***B65H 9/00*** | (2006.01) |

(52) U.S. Cl.

CPC ..... (2013.01); *B65H 29/40* (2013.01); *B65H 31/02* (2013.01); *G07D 11/0021* (2013.01); *B65H 5/008* (2013.01); *B65H 7/06* (2013.01); *B65H 9/004* (2013.01); *B65H 2301/4212* (2013.01); *B65H 2404/7414* (2013.01); *B65H 2404/742* (2013.01); *B65H 2511/222* (2013.01); *B65H 2511/413* (2013.01); *B65H 2701/1912* (2013.01)

USPC ..... 271/223; 271/171; 271/221

(56) References Cited

U.S. PATENT DOCUMENTS

| | | | | |
|---|---|---|---|---|
| 6,164,642 | A * | 12/2000 | Onipchenko et al. | 271/240 |
| 6,746,012 | B2 * | 6/2004 | Diews | 271/164 |
| 7,464,930 | B2 * | 12/2008 | Masuda et al. | 271/224 |
| 8,070,157 | B2 * | 12/2011 | Koyanagi | 271/241 |
| 8,430,398 | B2 * | 4/2013 | Kamichi | 271/171 |
| 8,820,734 | B2 * | 9/2014 | Miyakawa et al. | 271/171 |
| 2006/0244198 | A1 | 11/2006 | Stemmle et al. | |
| 2007/0222140 | A1 * | 9/2007 | Tsuchida | 271/171 |
| 2009/0096157 | A1 * | 4/2009 | Popejoy et al. | 271/254 |
| 2011/0163496 | A1 * | 7/2011 | Aoyama et al. | 271/254 |
| 2012/0319344 | A1 * | 12/2012 | Nakamichi | 270/58.07 |
| 2013/0270765 | A1 * | 10/2013 | ARAAKI et al. | 271/171 |

FOREIGN PATENT DOCUMENTS

| | | | | | |
|---|---|---|---|---|---|
| CN | 1591212 | A | | 3/2005 | |
| CN | 2763183 | Y | | 3/2006 | |
| CN | 1907826 | A | | 2/2007 | |
| CN | 200988243 | Y | | 12/2007 | |
| CN | 201002894 | Y | | 1/2008 | |
| CN | 201136713 | Y | | 10/2008 | |
| CN | 201707700 | U | | 1/2011 | |
| CN | 201713138 | U | | 1/2011 | |
| CN | 102152976 | A | | 8/2011 | |
| DE | 3415492 | A1 | | 10/1985 | |
| JP | 60220752 | A | * | 11/1985 | B41F 13/64 |
| JP | 01081721 | A | * | 3/1989 | B65H 1/04 |
| JP | 7041185 | A | | 2/1995 | |
| JP | 11049379 | A | | 2/1999 | |
| JP | 11228011 | A | | 8/1999 | |

* cited by examiner

SHEET-TYPE MEDIUM STACKING AND GUIDING DEVICE, AS WELL AS CONTROL SYSTEM AND METHOD BASED ON THE SAME

This application is the national phase of International Application No. PCT/CN2012/078358, titled "SHEET-TYPE MEDIUM STACKING AND GUIDING DEVICE, AS WELL AS CONTROL SYSTEM AND METHOD BASED ON THE SAME" filed on Jul. 9, 2012 which claims the benefit of priority to Chinese Patent Application No. 201110240238.8, titled "SHEET-TYPE MEDIUM STACKING AND GUIDING DEVICE, AS WELL AS CONTROL SYSTEM AND METHOD BASED ON THE SAME" filed with the Chinese State Intellectual Property Office on Aug. 19, 2011, the entire disclosures of which are incorporated herein by reference.

FIELD OF THE INVENTION

The invention relates to a device for tidying paper-like media, such as banknotes, papers and cheques, and particularly to a sheet-like medium stack guiding device, as well as a system and a method for controlling the same.

BACKGROUND OF THE INVENTION

With the development and progress of science and technology, some companies that need to handle large amounts of cash mostly use a paper money processing machine to implement some actions, such as inspecting, one-hundred-separating and bundling, in which one important aspect is to stack multiple banknotes tidily. At present, a tidying mechanism of most paper money processing machines cannot be applicable to all the banknotes, this is because only one fixing baffle plate is provided in the length direction of the paper money in the tidying mechanism, which cannot meet the requirement for tidying multiple types of banknotes. As described in the Chinese Patent Application for utility model No. 200520023084.7, the tidying range in the length direction of the banknote is limited by the stroke of a push plate, while the tidying range in the short-side direction is limited by the movement range of an electromagnet, a lever or the like, thereby only tidying a single type of banknote. In order to meet the requirement for tidying banknotes with different lengths, it usually needs to mount limit devices at a banknote entrance (or a banknote separating inlet) when tidying multiple banknotes. When tidying multiple types of banknotes, these limit devices need to be adjusted manually, and generally to be operated only after the device is opened, so that the operation is not enough convenient. Furthermore, the mounting of the limit devices at the banknote entrance (or the banknote separating inlet) does not facilitate the optimization of the arrangement of components and wastes useful space in the machine body.

SUMMARY OF THE INVENTION

Therefore, an object of the invention is to provide a sheet-like medium stack guiding device with a compact structure, which can meet stacking requirements of sheet-like media with different lengths. Based on this, the invention also provides a system and method for controlling the sheet-like medium stack guiding device, which may automatically tidy sheet-like media with different lengths to improve work efficiency greatly.

To solve the above technical problems, the invention provides a sheet-like medium stack guiding device, including:

a left limit plate and/or a right limit plate located at an outer end of a medium passage which is formed by a left passage plate and a right passage plate; and a driving mechanism being in a transmission connection with the left limit plate and/or the right limit plate, and adapted to drive the left limit plate and/or the right limit plate to move in a medium length direction.

Preferably, the driving mechanism includes a screw shaft and a screw driving motor which are connected together by a gear set, wherein the screw shaft is provided with threads having opposite screwing directions at a left end and a right end thereof respectively, the left limit plate and the right limit plate are provided with nuts corresponding to the threads of the screw shaft respectively, and the screw shaft is slidably mounted between the left limit plate and the right limit plate so that the left limit plate and the right limit plate are driven to move towards or away from each other under the driving of the screw motor.

Preferably, a guiding shaft is provided, wherein two ends of the guiding shaft is fixed to the left passage plate and the right passage plate respectively, and the guiding shaft is configured to pass through the left limit plate and the right limit plate.

Preferably, the left limit plate is coupled to a left guiding plate via a first left limit plate rotating shaft in such a manner to be rotatable and slidable in a guiding groove of the left guiding plate. The left guiding plate is rotatably connected to a left fixing plate via a second left guiding plate rotating shaft and a third left guiding plate rotating shaft, and the left fixing plate is fixed to the left passage plate. The right limit plate is coupled to a right guiding plate via a first right limit plate rotating shaft in such a manner to be rotatable and slidable in a guiding groove of the right guiding plate. The right guiding plate is rotatably connected to a right fixing plate via a second right guiding plate rotating shaft and a third right guiding plate rotating shaft, and the right fixing plate is fixed to the right passage plate.

Preferably, a sensor detecting piece is mounted on the right guiding plate; and a sensor is mounted such as to exteriorly correspond to the sensor detecting piece, and is adapted to detect an initial position of the sensor detecting piece.

Preferably, a flapping tidying mechanism is provided at the lower position of the left limit plate or the right limit plate, and is adapted to flap media at one side of the media. A medium stacking plate is mounted between the flapping tidying mechanism and the right limit plate, and is located outside a banknote stacking wheel.

Preferably, the flapping tidying mechanism includes a front plate and a rear plate. The front plate is located at one side of the medium stacking plate, and is slidably connected to the rear plate. The rear plate is slidably connected to a rear plate guiding shaft and is adapted to make a reciprocating movement under driving of a rear plate vibration mechanism.

Preferably, the device includes a front plate return spring, a front plate guiding shaft and a front plate guiding sleeve which form a front plate assembly along with the front plate, wherein the front plate guiding shaft is fixedly connected to the front plate after passing through the front plate guiding sleeve and the front plate return spring; the front plate guiding shaft is slidably connected to the rear plate through the front plate guiding sleeve; and the front plate spring is mounted between the front plate and the rear plate and is adapted to return the front plate.

Preferably, the rear plate vibration mechanism includes a tidying motor and an eccentric wheel, wherein the eccentric wheel is mounted on an output shaft of the tidying motor and is in contact with a driving surface of the rear plate; two ends of the rear plate guiding shaft are fixedly connected to a tidying motor supporting plate, such that the rear plate slides along the rear plate guiding shaft in a left-right direction under the action of the eccentric wheel.

Preferably, a rear plate return spring is provided, wherein one end of the rear plate return spring is connected to the tidying motor supporting plate and the other end of the rear plate return spring is connected to the rear plate, such that the working surface of the eccentric wheel is always in contact with the driving surface of the rear plate.

Preferably, a plurality of bearings are mounted on the tidying motor supporting plate such that the motor supporting plate slides along a sliding support plate in the left-right direction as the left limit plate moves. The sliding support plate and a connection plate of the sliding support plate are fixed to the left passage plate.

Preferably, a flapping tidying mechanism sensor and a flapping tidying mechanism sensor detecting piece are provided to detect a position of the rear plate.

Based on this, the control system for the sheet-like medium stack guiding device includes a controller including:

an image acquisition module configured to acquire image information of a medium;

a data processing module configured to judge a type of the medium according to pre-stored medium type image information, to search for a length of the medium according to the type of the medium, to calculate a distance to be adjusted according to the length of the medium, and to convert the distance to be adjusted into an amount of movement of an execution element;

a memory module configured to store image information and physical properties of multiple types of media, an initial position length value of the limit plate, a length adjusting conversion formula, and a conversion formula for converting a length adjustment value into an amount of movement of an execution element;

a central control processing module configured to schedule and control operating processes of the image acquisition module, the data processing module, a servo signal generating module, a detecting module and the memory module; and the servo signal generating module configured to output an execution element servo signal according to the amount of movement of the execution element.

Preferably, the controller includes the detecting module configured to acquire the initial position of a controlled object.

Accordingly, a control method for the sheet-like stack guiding device includes:

identifying a type of a medium to be tidied;

querying properties of the medium to be tidied according to the type of the medium, so as to obtain a length value of the medium; and performing calculation according to the length value of the medium and outputting an execution element servo signal for the driving mechanism, so as to drive the left limit plate and/or the right limit plate to move to a predetermined position in the medium length direction.

Accordingly, the control method for the sheet-like medium stack guiding device specifically includes:

acquiring image information of the medium;

judging the type of the medium according to pre-stored medium type image information;

searching for the length of the medium according to the type of the medium;

calculating a distance to be adjusted according to the length of the medium;

converting the distance to be adjusted into an amount of movement of an execution element; and outputting an execution element servo signal according to the amount of movement of the execution element.

Preferably, the method further includes:

detecting an initial position of a controlled object, so as to drive the left limit plate and/or the right limit plate after being reset to the initial position.

Compared with the prior art, the adjustable left limit plate and/or the adjustable right limit plate are/is provided in the invention, which can effectively increase the tidying range for the sheet-like medium and thus meet stacking requirements for the sheet-like media with different lengths. Particularly, a flapping tidying mechanism is provided to facilitate stacking neatly. By stacking and tidying with an automatic control system, the working efficiency is improved greatly and the labor intensity is reduced.

Figure 1:
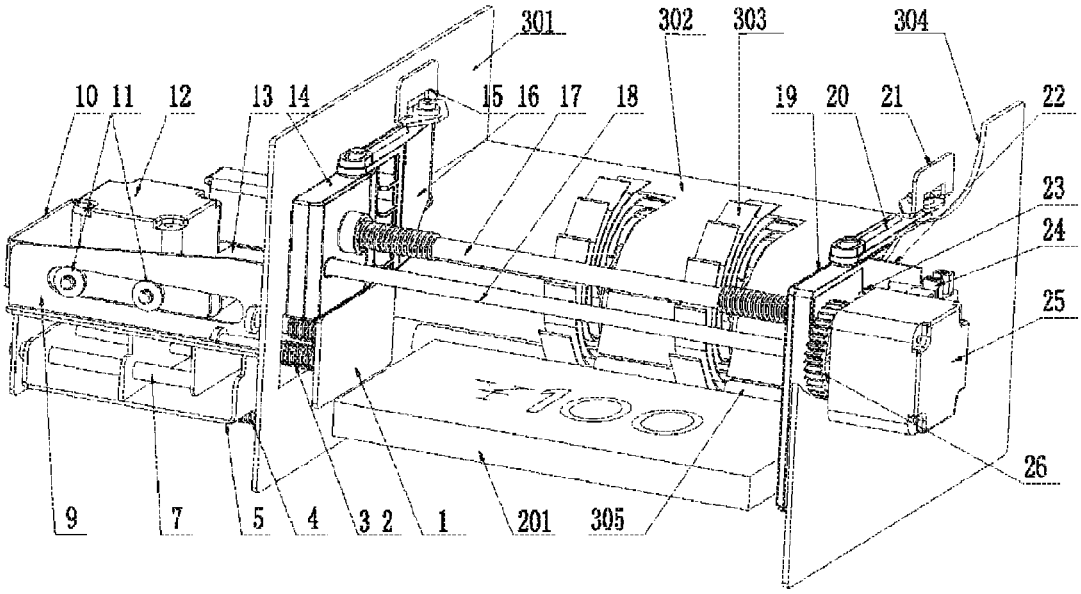
FIG. 1 is a perspective view of a first embodiment of a sheet-like medium stack guiding device of the invention.
Figure 2:
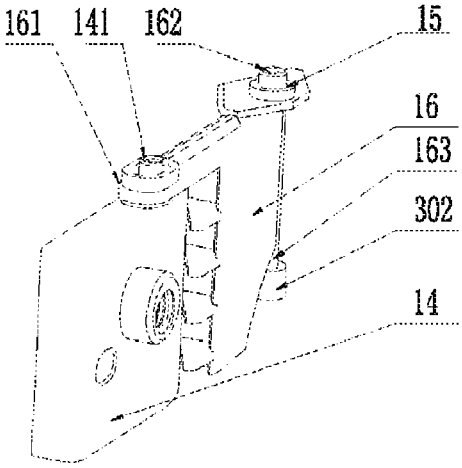
FIG. 2 is a structural view of a left limit plate in the sheet-like medium stack guiding device shown in FIG. 1.
Figure 3:
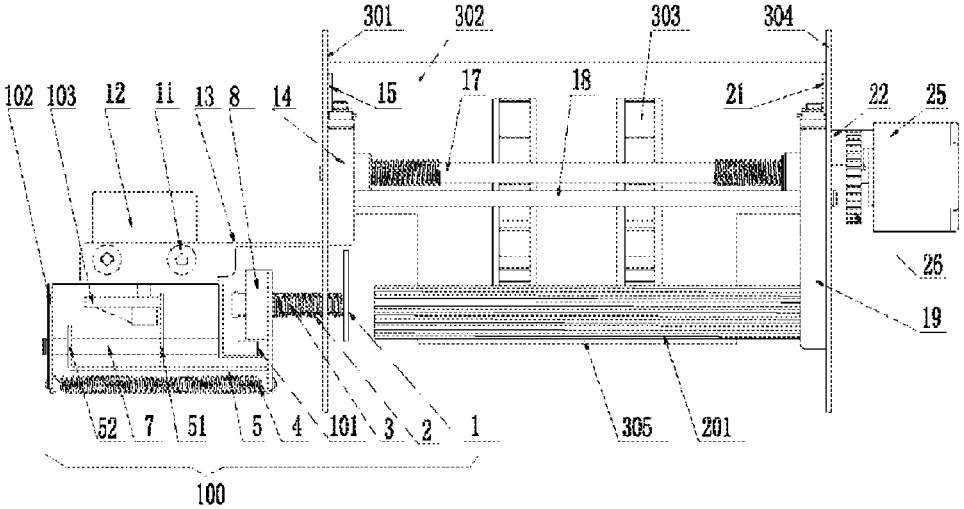
FIG. 3 is a front view of the sheet-like medium stack guiding device shown in FIG. 1.
Figure 4:
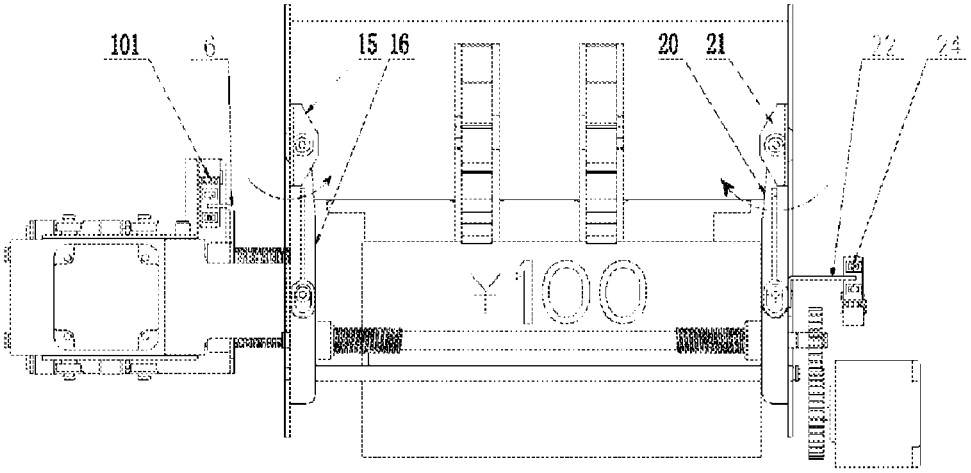
FIG. 4 is a top view of the sheet-like medium stack guiding device shown in FIG. 1 at an initial position.
Figure 5:
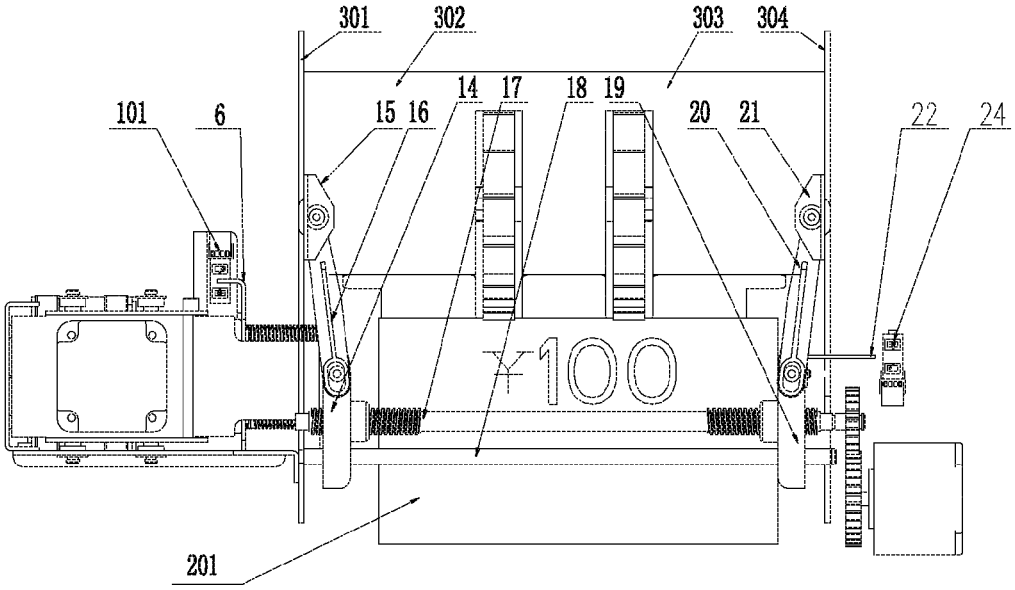
FIG. 5 is a top view of the sheet-like medium stack guiding device shown in FIG. 1 at a working position.
Figure 6:
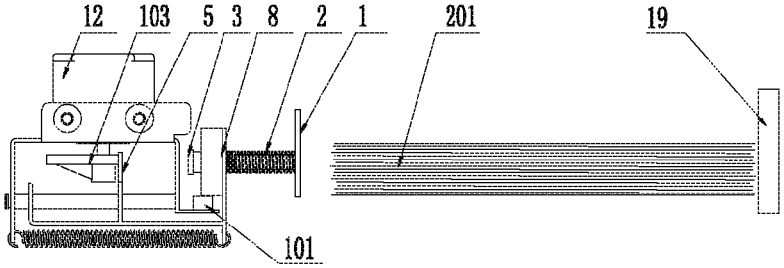
FIG. 6 is a view showing an initial position of a flapping tidying mechanism in the sheet-like medium stack guiding device shown in FIG. 1.
Figure 7:
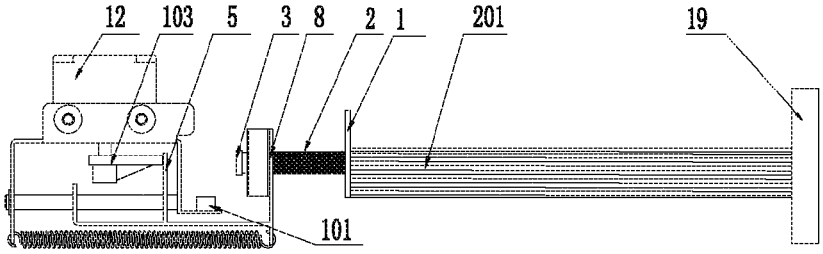
FIG. 7 is a view showing an working position of the flapping tidying mechanism in the sheet-like medium stack guiding device shown in FIG. 1.

In drawings, the list of reference numerals is as follows:

| | |
|---|---|
| 1. front plate; | 2. front plate return spring; |
| 3. front plate guiding shaft; | 4. rear plate return spring; |
| 5. rear plate; | 6. flapping tidying mechanism sensor detecting piece; |
| 7. rear plate guiding shaft; | 8. front plate guiding sleeve; |
| 9. sliding support plate; | 10. connection plate; |
| 11. bearing; | 12. tidying motor; |
| 13. linkage connection plate; | 14. left limit plate; |
| 15. left fixing plate; | 16. left guiding plate; |
| 17. screw shaft; | 18. guiding shaft; |
| 19. right limit plate; | 20. right guiding plate; |
| 21. right fixing plate; | 22. sensor detecting piece; |
| 23. screw driven gear; | 24. U-shaped sensor; |
| 25. screw driving motor; | 26. driving gear; |
| 51. rear plate middle vertical face; | 52. rear plate tail vertical face; |
| 100. flapping tidying mechanism; | 101. flapping tidying mechanism sensor; |
| 102. tidying motor supporting plate; | 103. eccentric wheel; |
| 141. first left limit plate rotating shaft; | 161. left guiding plate guiding groove; |
| 162. second left guiding plate rotating shaft; | 163. third left guiding plate rotating shaft; |
| 201. banknote stack; | 301. left passage plate; |
| 302. banknote inlet plate; | 303. stacking wheel; |
| 304. right passage plate; | 305. stacking plate. |

DETAILED DESCRIPTION OF THE INVENTION

In order to make those skilled in the art better understand the technical solutions of the invention, the invention is further described in detail hereinafter in conjunction with the drawings and specific embodiments by taking the banknote as an example.

Referring to FIGS. 1 to 7, a preferred embodiment of the sheet-like medium stack guiding device of the invention is shown, in which an adjustable left limit baffle plate and an adjustable right limit baffle plate are provided such as to adjust the spacing between the left limit baffle plate and the right limit baffle plate in the light of different lengths of the banknotes, thereby meeting the tidying requirements for multiple types of banknotes. Furthermore, a flapping tidying mechanism is provided to ensure banknotes to be stacked tidily.

Referring to FIGS. 1 to 5, a basic sheet-like medium stack guiding device is shown, which is applied on a sheet-like medium conveying passage for tidying the sheet-like media during stacking process of the sheet-like media. The implementation method for expanding the tidying range for the banknotes will be described in detail hereinafter. The device includes a left limit plate 14 and a right limit plate 19 which are distributed symmetrically relative to each other and are located at the outer end of a medium passage between a left passage plate 301 and a right passage plate 304. The left limit plate 14 is coupled to a left guiding plate 16 via a first left limit plate rotating shaft 141 in such a manner to be rotatable and slidable in a guiding groove 161 of the left guiding plate, and the left guiding plate 16 is rotatably connected to a left fixing plate 15 and a banknote inlet plate 302 via a second left guiding plate rotating shaft 162 and a third left guiding plate rotating shaft 163. There is a symmetry between the structure of the right limit plate 19 and the right guiding plate 20 and the structure of the left limit plate 14 and the left guiding plate 16, that is, the right guiding plate 20 is rotatably connected to a right fixing plate 21 and a banknote inlet plate 302 via a second right guiding plate rotating shaft and a third right guiding plate rotating shaft, except that the height of the right limit plate 19 is greater than the height of the left limit plate 14, which will not be described in detail herein.

A guiding shaft 18 is provided between the left passage plate 15 and the right passage plate 21, and passes through the left limit plate 14 and the right limit plate 19. The screw shaft 17 is slidably mounted between the left limit plate 14 and the right limit plate 19, and is provided with a left-hand trapezoidal thread and a right-hand trapezoidal thread respectively at the left end and the right end of the screw shaft 17. The left limit plate 14 and the right limit plate 19 are provided with trapezoidal nuts corresponding to the trapezoidal threads, respectively. The screw shaft 17 is driven by a screw driving motor 25 so as to drive the left limit plate 14 and the right limit plate 19 to move towards each other or move away from each other along the guiding shaft 18, thus adjusting the length between the guiding plates. As shown in FIG. 1, a driving gear 26 and a screw driven gear 23 are provided between the screw driving motor 25 and the screw shaft 17. However, other driving methods can also be used.

As shown in FIG. 1, a sensor detecting piece 22 is mounted on the right guiding plate 19, and a U-shaped sensor 24 is mounted and exteriorly corresponds to the sensor detecting piece 22, for sensing the initial position of the sensor detecting piece 22, so as to ensure that each adjustment of the spacing between the guiding plates begins from the initial position, thus reducing accumulation of movement error of the mechanism.

A flapping tidying mechanism 100 for tidying the stacked sheet-like media is correspondingly provided at the lower end of the left limit plate 14. The sheet-like medium stacking plate 305 is mounted between the flapping tidying mechanism 100 and the right limit plate 19 and corresponds to the stacking wheel 303.

Referring to FIGS. 1, and 3 to 5, the flapping tidying mechanism 100 in the sheet-like medium stack guiding device has a front plate assembly which can be contracted backwardly. The front plate assembly includes a front plate 1, a front plate return spring 2, a front plate guiding shaft 3 and a front plate guiding sleeve 8. A rear plate 5 is driven by an eccentric wheel 103, and a front plate guiding shaft 3 is mounted on the rear plate 5. When handling shortest banknotes in a certain subrange shift, the front plate 1 does not move due to a spring force. When handling longest banknotes in a certain subrange shift, the front plate 1 is subject to a resistance force to be retracted backwardly along the front plate guiding shaft 3, thereby achieving a complete adaptability to the banknotes to be tidied in the certain subrange shift. The structure of the tidying mechanism 100 will be further described in detail below.

The tidying motor supporting plate 102 is fixedly connected to the left limit plate 14 via a linkage connection plate 13 hinged with the tidying motor supporting plate 102. Four bearings 11 are mounted on the tidying motor supporting plate 102, such that the tidying motor supporting plate 102 and related parts mounted thereon can slide along the sliding support plate 9 in a left-right direction as the left limit plate 14 moves, wherein the sliding support plate 9 and a connection plate 10 are fixed to the left passage plate 301.

An eccentric wheel 103 is mounted on the shaft end of the tidying motor 12. The front plate 1, the font plate guiding shaft 2, the front plate return spring 3 and the front plate guiding sleeve 8 form a front plate assembly. The front plate guiding shaft 2 is fixedly connected to the front plate 1 after passing through the front plate guiding sleeve 8 and the front plate return spring 3, and is slidably connected to the rear plate 5 through the front plate guiding sleeve 8. The front plate spring 3 is mounted between the rear plate 5 and the front plate 1. The rear plate 5 is slidably connected to the rear plate guiding shaft 7 through the openings arranged in the rear plate middle vertical face (driving surface) 51 and in the rear plate tail vertical face 52. The left and right ends of the rear plate guiding shaft 7 are fixedly connected to the tidying motor supporting plate 102, such that the parts connected with the rear plate 5 can slide along the rear plate guiding shaft 7 in a left-right direction. The return force provided by the rear plate return spring 4 makes the working surface of the eccentric wheel 103 always contact with the left surface of the rear plate middle vertical face 5.

When the tidying motor 12 drives the eccentric wheel 103 to rotate, the eccentric wheel 13 drives the rear plate 5 and the front plate assembly connected to the rear plate 5 to slide on the rear plate guiding shaft 7 in a left-right direction. The reciprocating sliding of the front plate assembly in the left-right direction can achieve the function for flapping the banknotes. It can be known from the characteristics of the eccentric wheel that the tidying range of the flapping tidying mechanism 100 is the double of the eccentric distance of the eccentric wheel, which means that different banknote tidying ranges can be achieved by adjusting the eccentric distance of the eccentric wheel 103.

The flapping tidying mechanism 100 can be reset by detecting the position of the rear plate 5 with a flapping tidying mechanism sensor 101. The eccentric wheel 103 always is started from the position with a minimum eccentric distance. The existence of the return spring 3 in the front plate assembly compensates for the adjustment error of the left and right limit plates 14, 19; and the more important thing is that, the front plate 1 can be retracted under a force, thus effectively increasing the tidying range of the flapping tidying mechanism.

In the embodiment, the sheet-like medium stack guiding device can be efficiently applicable to multiple types of banknotes. For example, if banknotes with the length between 130 mm and 180 mm are desired to be tidied, four subrange shifts can be chosen, each having a length of 12.5 mm, and can be switched by the screw driving motor 25. It is assumed that the length for one subrange shift in a mechanism is L, and the shortest banknote length that can be processed by the mechanism in a certain period of time is L1 and the longest banknote length that can be processed by the mechanism in a certain period of time is L2. When a banknote with a length of L1 enters, the front plate 1 of the flapping tidying mechanism 100 does not act; and when a banknote with a length of L2 enters, the front plate 1 of the flapping tidying mechanism 100 moves backwardly by a length of L in order to adapt to the length of the banknote. When the eccentric wheel rotates to the short edge, the front plate 1 is reset by means of the front plate return spring 2. When a banknote with a length between L1 and L2 enters, the flapping tidying mechanism moves to an extent between the movement states in the two cases described above.

In the following, the entire operating process of the sheet-like medium stack guiding device will be illustrated briefly. Under normal circumstances, the banknote enters into a hollow chamber formed by the left and right limit plates 14, 19 through the left and right guiding plates 16, 20, and the front plate 1 moves along the front plate guiding shaft 3 in a left-right direction to tidy the banknote stack. Specifically, before being stacked, the banknotes are firstly stacked under the guiding of the left and right guiding plates, i.e. pre-tidying, so as to improve the subsequent tidying efficiency; when the banknotes are stacked on the banknote stacking plate 305, the flapping tidying mechanism 100 consecutively flaps the banknote stack 201 so that the banknotes are stacked neatly. Here, the right limit plate 19 moves to the left, reducing the flapping stroke of the banknote stack, which may save space for the device. In addition, the left and right limit plates move towards each other from the initial position each time, avoiding accumulated error in the automatic adjustment.

The reset process of the sheet-like medium stack guiding device is described briefly below. After receiving a reset command, the screw shaft 17 rotates such that the left and right limit plates 14, 19 move away from each other; when the sensor piece 22 triggers a U-shaped sensor 24, the screw shaft 17 stops rotating, and the reset of the left and right limit plates is completed. Then, the tidying motor 12 begins to rotate; and when the flapping tidying mechanism sensor detecting piece 6 on the rear plate 5 triggers the U-shaped flapping tidying mechanism sensor 101, the tidying motor 12 stops rotating, and the reset is completed. The two reset processes can be carried out sequentially or simultaneously, which will not affect the results.

Figure 8:
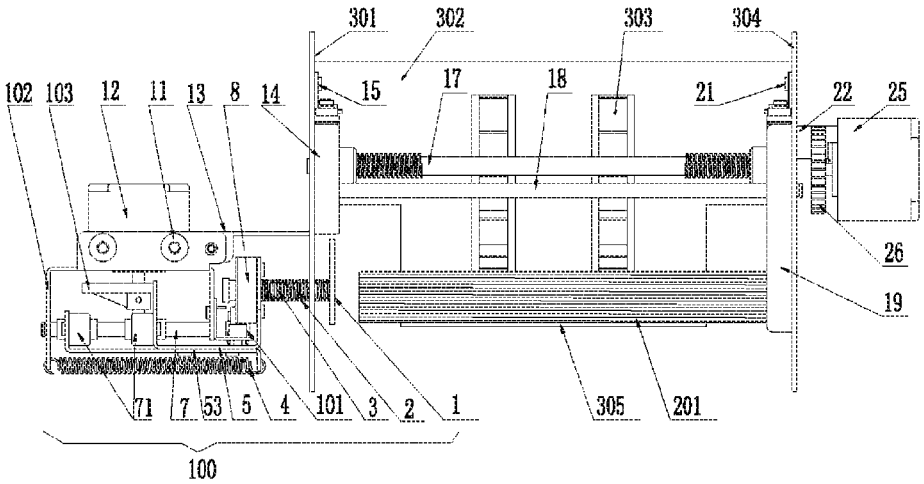
FIG. 8 is a front view of a second embodiment of the sheet-like medium stack guiding device of the invention.

Referring to FIG. 8, another preferred embodiment of the sheet-like medium stack guiding device is shown, which is different from the above embodiment in the structure of the rear plate 5 and the rear plate guiding shaft 7. In this embodiment, an N-shaped plate 53 is provided below the rear plate 5; and shaft shoulders 71 are provided on the rear plate guiding shaft 7 to limit the left vertical face of the rear plate 5 and the left vertical face of the N-shaped plate respectively. This structure in this case is easy to be manufactured. Other parts are the same as that in the first embodiment, which will not be described in detail herein.

Base on the above sheet-like medium stack guiding device, a guiding control system for a sheet-like medium stack according to the invention will be illustrated hereinafter. The control system includes a controller. The controller is configured to identify the type of a medium to be tidied, query properties of the medium to be tidied according to the type of the medium to obtain the length value of the medium, perform calculation according to the length value of the medium and output an execution element servo signal of the driving mechanism to drive the left limit plate and/or the right limit plate to move to a predetermined position in the length direction of the medium. In the invention, the controller is an important part of the control system and is illustrated hereinafter.

Figure 9:
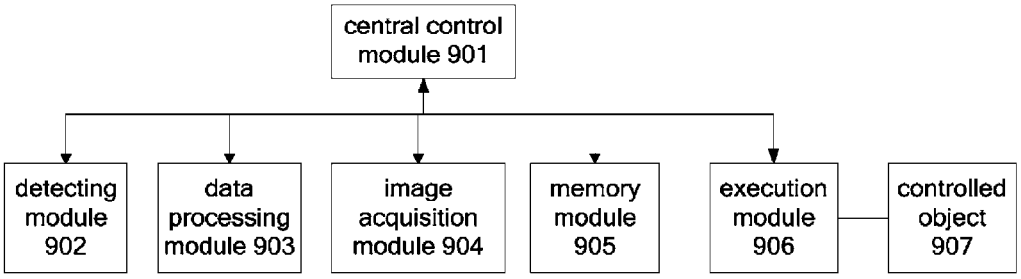
FIG. 9 is a block diagram of a system for controlling the sheet-like medium stack guiding device of the invention.

Referring to FIG. 9, a block diagram of a system for controlling the sheet-like medium stack guiding device is shown. The control system includes a central control module 901, a detecting module 902, a data processing module 903, an image acquisition module 904, a memory module 905, an execution module 906, etc., wherein the central control module 901, the detecting module 902, the data processing module 903, the image acquisition module 904, the memory module 905 and a servo signal generating module in the execution module 906 are parts of the controller. The above parts are described individually hereinafter.

The image acquisition module 904 includes a photoelectric sensor and is configured to acquire image information of a banknote.

The memory module 905 stores banknote image information, banknote physical properties (including banknote length information), initial position length value of the limit plate, a length adjusting conversion formula, and a conversion formula for converting a length adjustment value into an amount of movement of an execution element.

The data processing module 903 is configured to judge the type of the banknote according to pre-stored banknote image information in the memory module 905, find the length of the banknote according to the type of the banknote, calculate a distance to be adjusted according to the length of the banknote; and convert the distance to be adjusted into a required amount of movement of the execution element in view of gear characteristics (or other driving mechanism parameters) and the like.

The detecting module 902 is configured to detect the initial position of a controlled object in the execution module.

The execution module 906 includes a servo signal generating module therein, and is configured to achieve the amount of movement calculated by the data processing module 903 and to output an execution element servo signal. The execution module 906 also includes a motor and the above sheet-like medium stack guiding device driven by the motor, wherein the spacing between the left limit plate and/or the right limit plate in the sheet-like medium stack guiding device is referred to as the controlled object 907, and the left limit plate and/or the right limit plate move/moves to a predetermined position in the length direction of the medium.

The central control module 901 is configured to schedule and control operation processes of the above modules, so that the modules can run harmoniously to ensure the normal operation of the entire system.

The above stack guiding control system forms an automatic limit mechanism, in which the important thing is how to acquire the length of the banknote and perform corresponding adjustment. In the following, the operating principle of the control system will be further illustrated with reference to FIG. 1.

Specifically, the operation process of the embodiment is as follows: obtaining image information of the banknote by the image acquisition module 904; reading the image information of the banknote by the data processing module 903, then identifying the type of the banknote in the memory module 905, and Obtaining the length of the banknote required to be processed according to a comparison table of denomination versus length of banknotes; then sending the length information to the data processing module 903 by the central control module 901; and calculating a distance to be adjusted according to the banknote length and converting the distance into a required amount of movement of the execution element by the data processing module 903.

The controlled object, i.e. the limit length between the two limit plates, is the longest banknote length required to be processed. More preferably, the limit length is the longest banknote length required to be processed plus a margin.

For example, given that the screw pitch of the selected screw shaft 17 is 2 mm, when the screw shaft rotates one revolution, the left limit plate 14 and the right limit plate 19 move towards each other or move away from each other by a distance of 4 mm. Further, given the parameters: a selected margin being 8 mm, the initial limit length between the two limit plates being 164 mm, a stepper motor having a step angle of 1.8 degrees, and a transmission ratio of the mechanism being 1:1, the comparison table of the limit length versus the screw rotation number for RMB 10-100 yuan is as follows.

TABLE 1 comparison of banknote denomination and length versus control parameters

| Serial number | Denomination (Yuan) | Length (mm) | Limit length (mm) | screw rotation number (n) | required pulse number of stepper motor (pps) |
|---|---|---|---|---|---|
| 1 | 10 | 140 | 148 | 4 | 800 |
| 2 | 20 | 145 | 153 | 2.75 | 550 |
| 3 | 50 | 150 | 158 | 1.5 | 300 |
| 4 | 100 | 156 | 164 | 0 | 0 |

In the table, pps=200*n where pps indicates the required pulse number of the stepper motor; n indicates screw rotation number; and 200 means that it needs 200 pulse signals for the stepper motor to make one revolution.

It can be seen from table 1 that, the variation range of the banknote length is 16 mm, and the required number of screw rotations is reduced by one half since the left and right limit plates 14, 19 move simultaneously. In other words, the use of the screw shaft 17 as the driving part of the automatic limit mechanism can make the required stroke reduced by half, thus simplifying the structure.

When the central control module 801 determines by means of the detecting module 802 that the controlled object has been in the initial position, the execution module can act according to the data as obtained from table 1 to complete the adjusting action.

When the central control module 801 does not receive a signal indicating that the controlled object has been reset, the execution element needs to execute a reverse action; and after the central control module 801 receives the signal, the execution element acts according to the data as listed in the table.

Accordingly, the method for controlling the sheet-like medium stack guiding device includes: identifying the type of a medium to be tidied; querying properties of the medium to be tidied according to the type of the medium to obtain the length value of the medium; and performing calculation according to the length value of the medium and outputting an execution element servo signal for the driving mechanism, so as to drive the left limit plate and/or the right limit plate to move to a predetermined position in the length direction of the medium.

Preferably, the type of the current medium to be processed is determined by acquiring image information of the banknote and performing comparison on the acquired image information of the banknote, and then the adaptive control is performed, which will be described briefly hereinafter.

Figure 10:
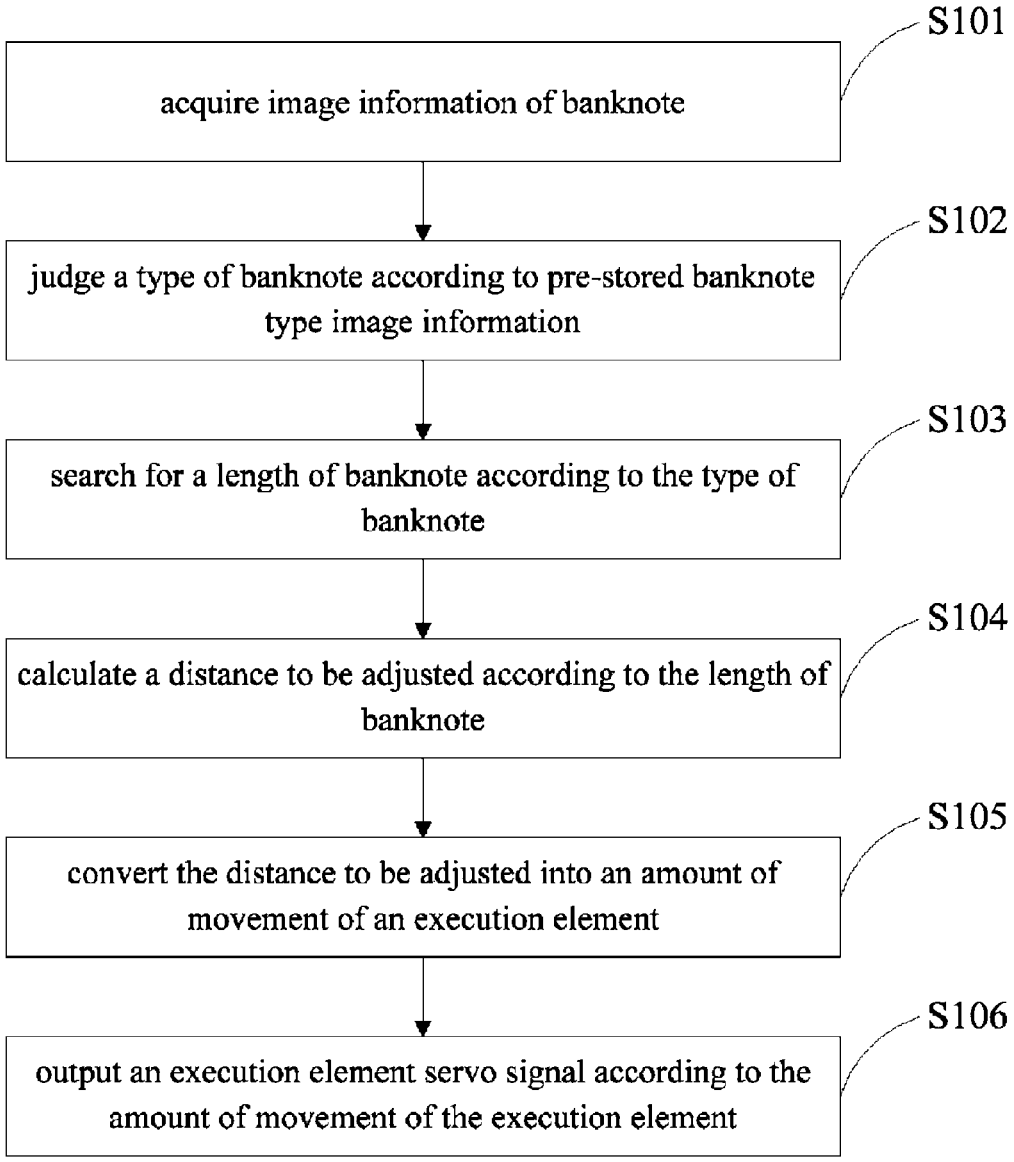
FIG. 10 is a flow chart of a method for controlling the sheet-like medium stack guiding device of the invention.

Referring to FIG. 10, a preferred embodiment of the method for controlling the sheet-like medium stack guiding device is shown, which includes the following steps:

S101, acquiring image information of the banknote, which may be obtained by using an image recognizer;

S102, judging the type of the banknote according to pre-stored banknote type image information, that is, seeking the type of the banknote in a memory module after reading the image information of the banknote;

S103, searching for the length of the banknote according to the type of the banknote, for example, obtaining the length of the banknote to be processed based on the comparison table of the denomination versus length of the banknote;

S104, calculating a distance to be adjusted according to the banknote length, which may be calculated by a pre-set formula or obtained by looking up the table;

S105, converting the distance to be adjusted into an amount of movement of the execution element, specifically, obtaining a required amount of movement of the execution element based on the distance to be adjusted in view of gear characteristics (or other driving mechanism parameters) and the like; and S106, outputting an execution element servo signal according to the amount of movement of the execution element, so as to drive the left limit plate and/or the right limit plate to a predetermined position in the length direction of the banknote.

In the embodiment, the initial position of the controlled object is detected so that the left limit plate and/or the right limit plate are/is driven after being reset to the initial position.

Therefore, by tidying the banknote stack in an automatic control manner, work efficiency is greatly improved, and labor intensity is reduced.

The above described is only preferred embodiments of the invention. It should be noted that, the above preferred embodiments should not be regarded as limiting the invention, and the scope of protection of the invention should be defined by the claims. Also, numerous variations and modifications can be made by those skilled in the art without departing from the sprit and scope of the invention, and these variations and modifications should also be deemed as falling into the scope of protection of the invention.

The invention claimed is:

1. A sheet-like medium stack guiding device, comprising:

at least one of a left limit plate and a right limit plate located at an outer end of a medium passage which is formed by a left passage plate and a right passage plate; and a driving mechanism being in a transmission connection with at least one of the left limit plate and the right limit plate, and adapted to drive at least one of the left limit plate and the right limit plate to move in a medium length direction;

wherein the driving mechanism comprises a screw shaft and a screw driving motor which are connected together by a gear set, and wherein the screw shaft is provided with threads having opposite screwing directions at a left end and a right end thereof respectively, the left limit plate and the right limit plate are provided with nuts corresponding to the threads of the screw shaft respectively, and the screw shaft is slidably mounted between the left limit plate and the right limit plate so that the left limit plate and the right limit plate are driven to move towards or away from each other under the driving of the screw motor;

two ends of a guiding shaft is fixed to the left passage plate and the right passage plate respectively, and the guiding shaft is configured to pass through the left limit plate and the right limit plate; and the left limit plate is coupled to a left guiding plate via a first left limit plate rotating shaft in such a manner to be rotatable and slidable in a guiding groove of the left guiding plate, the left guiding plate is rotatably connected to a left fixing plate via a second left guiding plate rotating shaft and a third left guiding plate rotating shaft, and the left fixing plate is fixed to the left passage plate; the right limit plate is coupled to a right guiding plate via a first right limit plate rotating shaft in such a manner to be rotatable and slidable in a guiding groove of the right guiding plate, the right guiding plate is rotatably connected to a right fixing plate via a second right guiding plate rotating shaft and a third right guiding plate rotating shaft, and the right fixing plate is fixed to the right passage plate.

2. The sheet-like medium stack guiding device according to claim 1, wherein a sensor detecting piece is mounted on the right guiding plate; and a sensor is mounted such as to exteriorly correspond to the sensor detecting piece, and is adapted to detect an initial position of the sensor detecting piece.

3. The sheet-like medium stack guiding device according to claim 1, further comprising a flapping tidying mechanism, wherein the flapping tidying mechanism is located at a lower position of the left limit plate or the right limit plate and is adapted to flap media at one side of the media; a medium stacking plate is mounted between the flapping tidying mechanism and the right limit plate, and is located outside a banknote stacking wheel.

4. The sheet-like medium stack guiding device according to claim 3, wherein the flapping tidying mechanism comprises a front plate and a rear plate; the front plate is located at one side of the medium stacking plate, and is slidably connected to the rear plate; the rear plate is slidably connected to a rear plate guiding shaft and is adapted to make a reciprocating movement under driving of a rear plate vibration mechanism.

5. The sheet-like medium stack guiding device according to claim 4, comprising a front plate return spring, a front plate guiding shaft and a front plate guiding sleeve which form a front plate assembly along with the front plate, wherein the front plate guiding shaft is fixedly connected to the front plate after passing through the front plate guiding sleeve and the front plate return spring; the front plate guiding shaft is slidably connected to the rear plate through the front plate guiding sleeve; and the front plate spring is mounted between the front plate and the rear plate and is adapted to return the front plate.

6. The sheet-like medium stack guiding device according to claim 4, wherein the rear plate vibration mechanism comprises a tidying motor and an eccentric wheel, and wherein the eccentric wheel is mounted on an output shaft of the tidying motor and is in contact with a driving surface of the rear plate; two ends of the rear plate guiding shaft are fixedly connected to a tidying motor supporting plate, such that the rear plate slides along the rear plate guiding shaft in a left-right direction under the action of the eccentric wheel.

7. The sheet-like medium stack guiding device according to claim 6, further comprising a rear plate return spring, wherein one end of the rear plate return spring is connected to the tidying motor supporting plate and the other end of the rear plate return spring is connected to the rear plate, such that the working surface of the eccentric wheel is always in contact with the driving surface of the rear plate.

8. The sheet-like medium stack guiding device according to claim 6, wherein a plurality of bearings are mounted on the tidying motor supporting plate such that the motor supporting plate slides along a sliding support plate in the left-right direction as the left limit plate moves, and wherein the sliding support plate and a connection plate of the sliding support plate are fixed to the left passage plate.

9. The sheet-like medium stack guiding device according to claim 4, wherein a flapping tidying mechanism sensor and a flapping tidying mechanism sensor detecting piece are provided to detect a position of the rear plate.

10. A control system for the sheet-like medium stack guiding device according to claim 1, comprising a controller, wherein the controller comprises:

an image acquisition module configured to acquire image information of a medium;

a data processing module configured to judge a type of the medium according to pre-stored medium type image information, to search for a length of the medium according to the type of the medium, to calculate a distance to be adjusted according to the length of the medium, and to convert the distance to be adjusted into an amount of movement of an execution element;

a memory module configured to store image information and physical properties of multiple types of media, an initial position length value of the limit plate, a length adjusting conversion formula, and a conversion formula for converting a length adjustment value into an amount of movement of an execution element;

a central control processing module configured to schedule and control operating processes of the image acquisition module, the data processing module, a servo signal generating module, a detecting module and the memory module; and the servo signal generating module configured to output an execution element servo signal according to the amount of movement of the execution element.

11. The control system according to claim 10, wherein the controller comprises the detecting module configured to acquire an initial position of a controlled object.

12. A method for controlling a sheet-like stack guiding device, comprising:

identifying a type of a medium to be tidied;

querying properties of the medium to be tidied according to the type of the medium, so as to obtain a length value of the medium; and performing calculation according to the length value of the medium and outputting an execution element servo signal for a driving mechanism, so as to drive at least one of a left limit plate and a right limit plate to move to a predetermined position in the medium length direction.

13. The method according to claim 12, comprising:

acquiring image information of the medium;

judging a type of the medium according to pre-stored medium type image information;

searching for a length of the medium according to the type of the medium;

calculating a distance to be adjusted according to the length of the medium;

converting the distance to be adjusted into an amount of movement of an execution element; and outputting an execution element servo signal according to the amount of movement of the execution element.

14. The method according to claim 13, further comprising:

detecting an initial position of a controlled object, so as to drive at least one of the left limit plate and the right limit plate after being reset to the initial position.

15. The method according to claim 12, further comprising:

detecting an initial position of a controlled object, so as to drive at least one of the left limit plate and the right limit plate after being reset to the initial position.

* * * * *